US008585178B2

(12) United States Patent
Price

(10) Patent No.: US 8,585,178 B2
(45) Date of Patent: Nov. 19, 2013

(54) CARRIAGE PRINTER WITH ADAPTIVE MOTION CONTROL

(75) Inventor: Brian Gray Price, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 85 days.

(21) Appl. No.: 13/307,523

(22) Filed: Nov. 30, 2011

(65) Prior Publication Data

US 2013/0135369 A1 May 30, 2013

(51) Int. Cl.
*B41J 23/00* (2006.01)

(52) U.S. Cl.
USPC ..... 347/37

(58) Field of Classification Search
CPC ..... B41J 2/04508; B41J 2/04528
USPC ..... 347/9, 104, 108, 109, 37
See application file for complete search history.

(56) References Cited

U.S. PATENT DOCUMENTS 6,116,707 A * 9/2000 Avida ..... 346/139 R
6,543,892 B2 * 4/2003 Kubota et al. ..... 347/109
7,350,902 B2 4/2008 Dietl et al.

* cited by examiner

*Primary Examiner* — An Do
(74) *Attorney, Agent, or Firm* — Peyton C. Watkins

(57) ABSTRACT

A carriage printer includes a printhead; a print region; a carriage configured to move the printhead back and forth across the print region; a motor for moving the carriage; a housing; a motion detector for detecting motion of the carriage printer; and a controller configured to control the motor, the controller including a motor control profile that is adaptable based upon the detected motion of the printer housing.

16 Claims, 9 Drawing Sheets

CARRIAGE PRINTER WITH ADAPTIVE MOTION CONTROL

CROSS REFERENCE TO RELATED APPLICATION

Reference is made to commonly assigned, co-pending U.S. patent application Ser. No. 13/307,568 filed Nov. 30, 2011, entitled "Adaptive Motion Control for Carriage Printer" by Brian Price, the disclosure of which is herein incorporated by reference.

FIELD OF THE INVENTION

The present invention relates generally to motion control for a carriage printer, and more particularly to adaptive motion control of the printer within the user's environment.

BACKGROUND OF THE INVENTION

A common type of printer architecture is a carriage printer, where a printhead array of marking elements is somewhat smaller than an extent of a region of interest for printing on a recording medium and a printhead is mounted on a carriage. In a carriage printer, the recording medium is advanced a given distance along a media advance direction and then stopped. While the recording medium is stopped, the printhead is moved by the carriage in a carriage scan direction that is substantially perpendicular to the media advance direction as marks are controllably made by marking elements. After the printhead has printed a swath of an image while traversing the recording medium, the recording medium is advanced, the carriage direction of motion is reversed, and the image is formed swath by swath.

One example of a carriage printer is an inkjet printer. An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator can be one of various types, including a heater that vaporizes some of the ink in a pressurization chamber in order to propel a droplet out of an orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the printhead is moved relative to the recording medium.

Faster printing throughput can be achieved in the carriage printer by printing at a faster carriage speed. However, the distance (d) required to accelerate from a stopped position to a constant velocity $v_c$ (and similarly to decelerate to a stopped position) is given by $d=v_c^2/2a$, where (a) is the acceleration. Therefore, as the carriage velocity is increased, it is desirable to increase the acceleration so that the width of the acceleration region beyond the print region doesn't increase to unacceptable levels, requiring that the printer be significantly wider than the print media. Such acceleration and deceleration can cause significant forces, particularly for carriages having a large mass, which can tend to cause the carriage printer to shake.

Many inkjet printers carry their ink supplies on the carriage. It is desirable for the ink supplies of the various colors (typically cyan, magenta, yellow and black, and sometimes other inks as well) be large enough for printing of at least several hundred pages, so that the user is not required to replace ink tanks too frequently. However, the more ink that is carried by the carriage, the higher the carriage mass is, and consequently the higher the forces are that result when the carriage accelerates and decelerates.

Different users of printers have different work environments that are not always predictable. Many users operate their printers on a sturdy work surface such as a massive desk. Others operate their printers on a surface, such as a file cabinet, that is not generally intended as a support surface for a printer. Still other users operate their printer on whatever type of table they happen to have. For example, some users operate their printers on lightweight card tables having foldable legs. A relatively flimsy work surface such as this can be more dramatically impacted by carriage forces than a sturdy support structure. The resulting shaking of the work surface can be noisy and annoying, and can result in damage. For example, if the user has a laptop computer, a carriage printer, some documents and a glass of water on a card table that is caused to shake by carriage motion, water could slosh out of the glass and onto the documents or laptop computer and damage them.

Printer manufacturers are thus typically constrained by the unpredictability of the user's environment and make tradeoffs between slowing down printing throughput by reducing carriage acceleration and limiting the amount of ink that is moved by the carriage. What is needed is a carriage printer and a method of operating the printer that is able to monitor its motion within the user's environment and adjust its carriage motion control accordingly.

SUMMARY OF THE INVENTION

The present invention is directed to overcoming one or more of the problems set forth above. Briefly summarized, according to one aspect of the invention, the invention resides in a carriage printer includes a printhead; a print region; a carriage configured to move the printhead back and forth across the print region; a motor for moving the carriage; a housing; a motion detector for detecting motion of the carriage printer; and a controller configured to control the motor, the controller including a motor control profile that is adaptable based upon the detected motion of the printer housing.

DETAILED DESCRIPTION OF THE INVENTION

Figure 1:
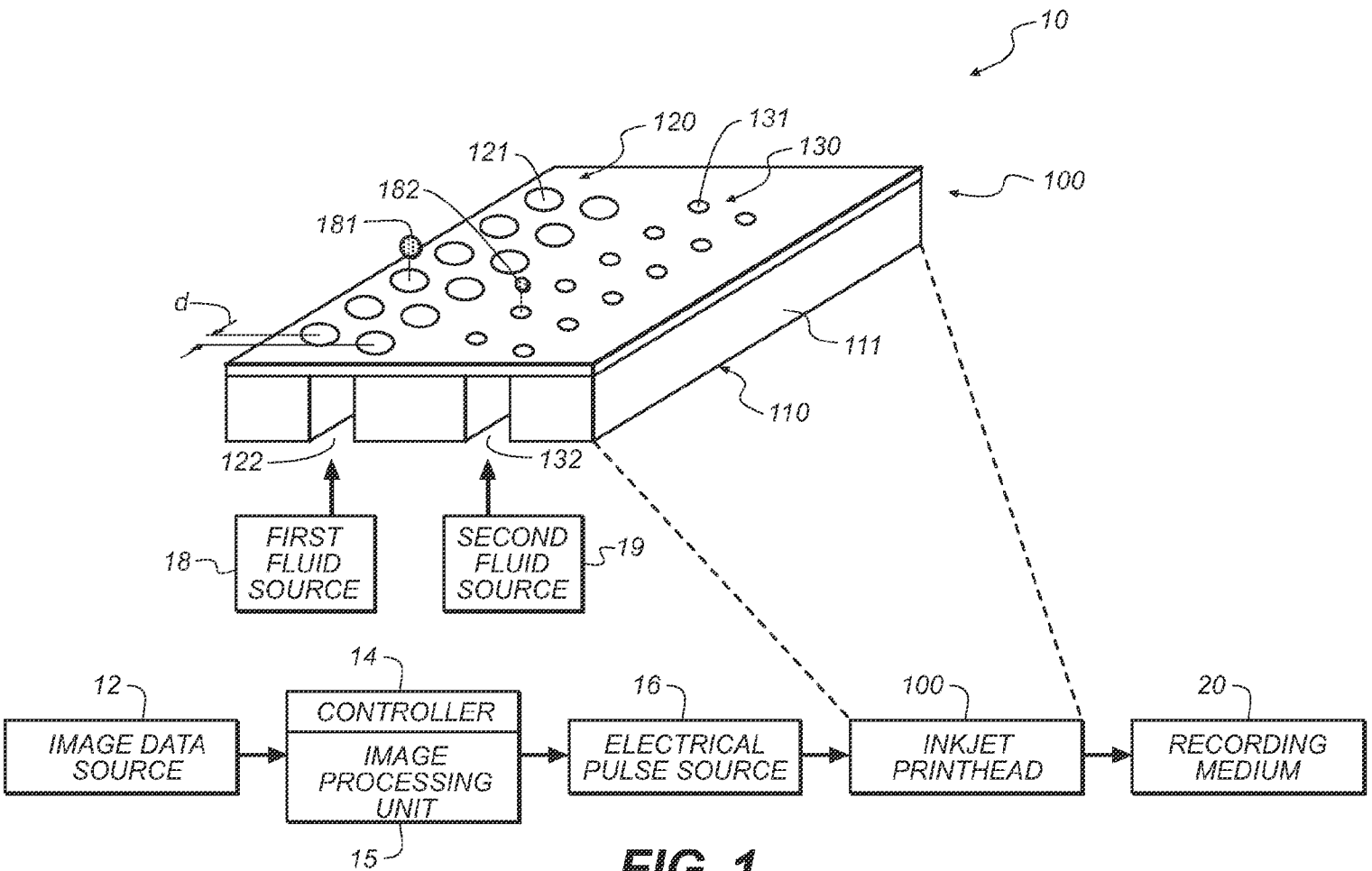
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays 120, 130 disposed at a surface of inkjet printhead die 110. Nozzles 121 in the first nozzle array 120 have a larger opening area than nozzles 131 in the second nozzle array 130. In this example, each of the two nozzle arrays 120, 130 has two staggered rows of nozzles, each row having a nozzle density of 600 per inch. The effective nozzle density then in each array is 1200 per inch (i.e. d=1/1200 inch in FIG. 1). If pixels on a recording medium 20 were sequentially numbered along a paper advance direction, the nozzles from one row of an array would print the odd numbered pixels, while the nozzles from the other row of the array would print the even numbered pixels.

In fluid communication with each nozzle array 120, 130 is a corresponding ink delivery pathway 122, 132. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die 110 are arranged on a support member as discussed below relative to FIG. 2. In FIG. 1, first ink source 18 supplies ink to first nozzle array 120 via ink delivery pathway 122, and a second ink source 19 supplies ink to second nozzle array 130 via ink delivery pathway 132. Although distinct ink sources 18 and 19 are shown, in some applications it can be beneficial to have a single ink source supplying ink to both the first nozzle array 120 and the second nozzle array 130 via ink delivery pathways 122 and 132 respectively. Also, in some embodiments, fewer than two or more than two nozzle arrays 120, 130 can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
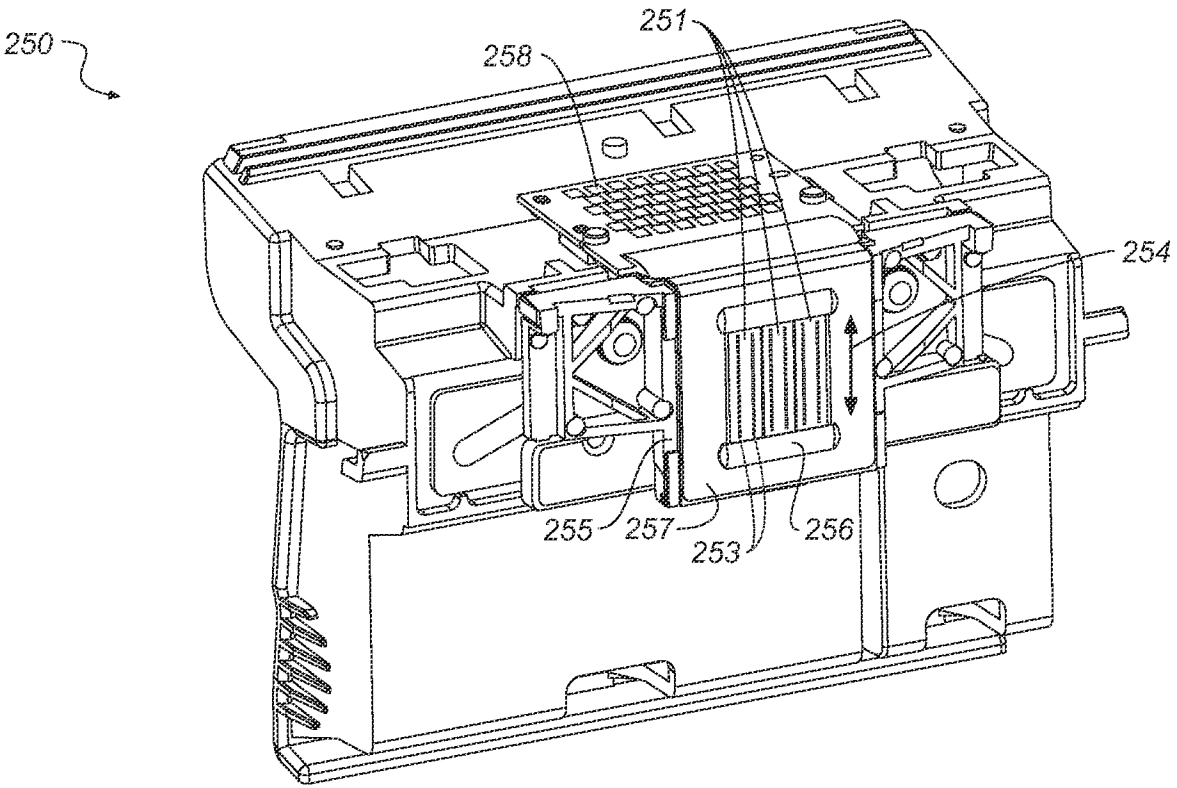
FIG. 2 is a perspective of a portion of a printhead.

FIG. 2 shows a perspective view of a portion of a printhead 250, which is an example of the inkjet printhead 100. Printhead 250 includes three printhead die 251 (similar to printhead die 110 in FIG. 1) that are affixed to a mounting substrate 255. The surface of the mounting substrate 255 to which the printhead die 250 are bonded is also called a face 252 of the printhead (see FIG. 10). Each printhead die 251 contains two nozzle arrays 253, so that printhead 250 contains six nozzle arrays 253 altogether. The six nozzle arrays 253 in this example are each be connected to ink sources (not shown in FIG. 2), such as cyan, magenta, yellow, text black, photo black, and protective fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flexible circuit 257 to which the printhead die 251 are electrically interconnected, for example, by wire bonding or TAB bonding. Flexible circuit 257 is also adhered to mounting substrate 255, and surrounds the printhead die 250. The interconnections are covered by an encapsulant 256 to protect them. Flexible circuit 257 bends around the side of printhead 250 and connects to a connector board 258 on rear wall 275. When printhead 250 is mounted into the carriage 200, connector board 258 is electrically connected to a connector 244 on the carriage 200, so that electrical signals can be transmitted to the printhead die 251.

Figure 3:
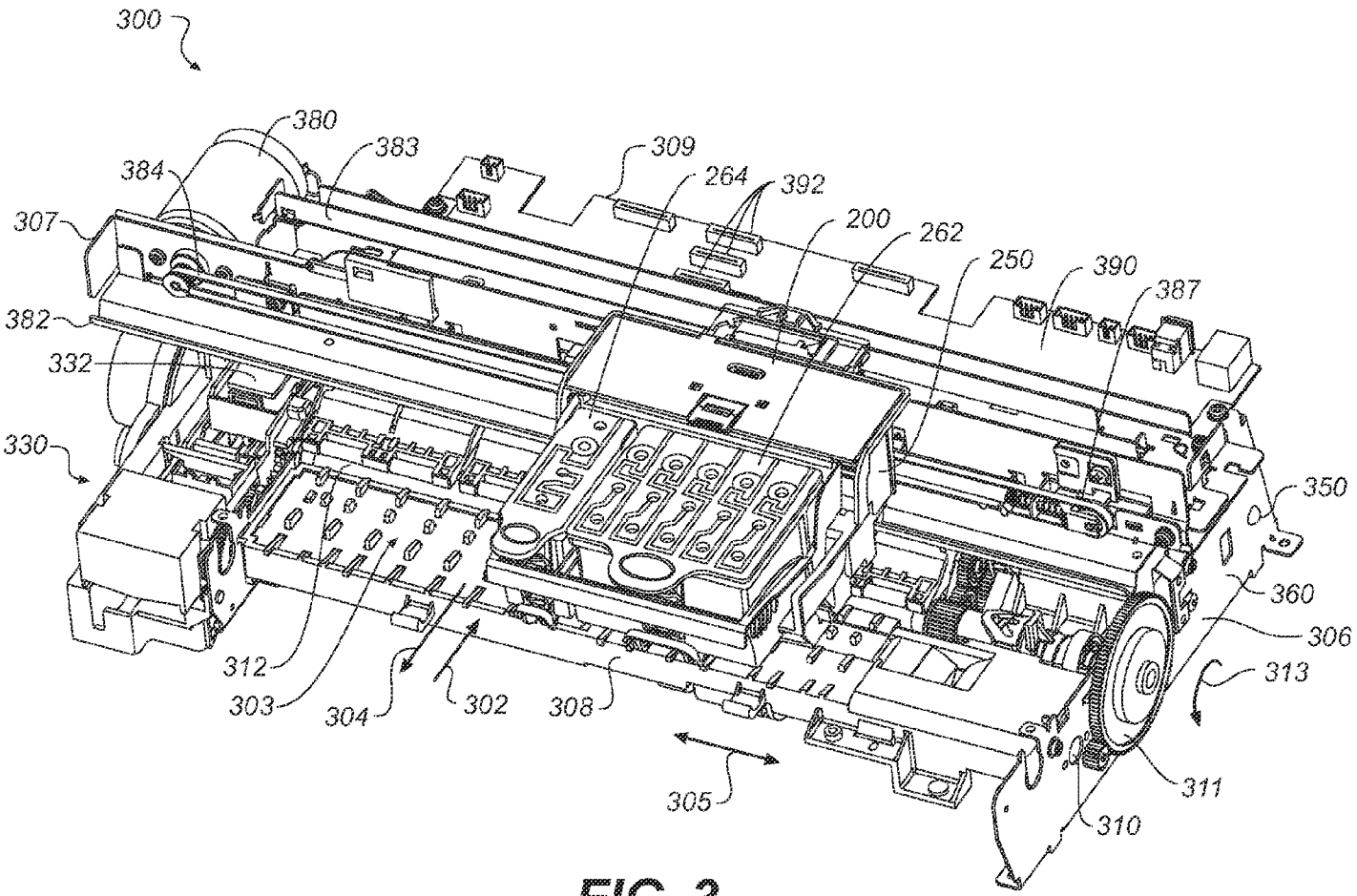
FIG. 3 is a perspective of a portion of a carriage printer including a motion detector according to an embodiment.

FIG. 3 shows a portion of a desktop carriage printer. Some of the parts of the printer have been hidden in the view shown in FIG. 3 so that other parts can be more clearly seen. A printer chassis 300 has a platen 301 in print region 303 across which carriage 200 is moved back and forth in a carriage scan direction 305 between a right side 306 and a left side 307 of printer chassis 300, while drops are ejected from printhead die 251 (not shown in FIG. 3) on printhead 250 that is mounted on carriage 200. Paper or other recording medium is held substantially flat against platen 301. A Carriage motor 380 moves a belt 384 to move carriage 200 along carriage a guide rail 382. An encoder sensor (not shown) is mounted on carriage 200 and indicates carriage location relative to a linear encoder 383.

Carriage motor 380 and a mount for a pulley 387 at the opposite end of belt 384 are bolted to a portion of frame 360 of printer chassis 300. Forces due to acceleration and deceleration of carriage 200 at the beginning and end of passes across print region 303 are transmitted to frame 360 through belt 384, carriage motor 380, and pulley 387. According to an embodiment of the invention, a motion detector 350, such as an accelerometer is affixed to printer frame 360 for detecting motion of the carriage printer, typically along carriage scan direction 305 due to acceleration and deceleration of carriage 200. The magnitude of the acceleration and deceleration applied to the carriage 200 is typically in a range of 1g to 3g, where g is the strength of earth's gravitational field at its surface, approximately 9.81 m/sec$^2$.

The mounting orientation of printhead 250 is rotated relative to the view in FIG. 2, so that the printhead die 251 are located at the bottom side of printhead 250, the droplets of ink being ejected downward onto the recording medium in print region 303 in the view of FIG. 3. A multi-chamber ink tank 262, in this example, contains five ink sources: cyan, magenta, yellow, photo black and colorless protective fluid; while a single-chamber ink tank 264 contains the ink source for text black. Ink tanks 262 and 264 can include electrical contacts (not shown) for data storage devices, for example, to track ink usage. In other arrangements, rather than having a multi-chamber ink tank to hold several ink sources, all ink sources are held in individual single chamber ink tanks. In any case, the ink sources in the configuration shown in FIG. 3 are mounted on printhead 250 which is moved by carriage 200, so the mass of the ink contributes to the mass that is accelerated and decelerated at the ends of printing passes.

Figure 4:
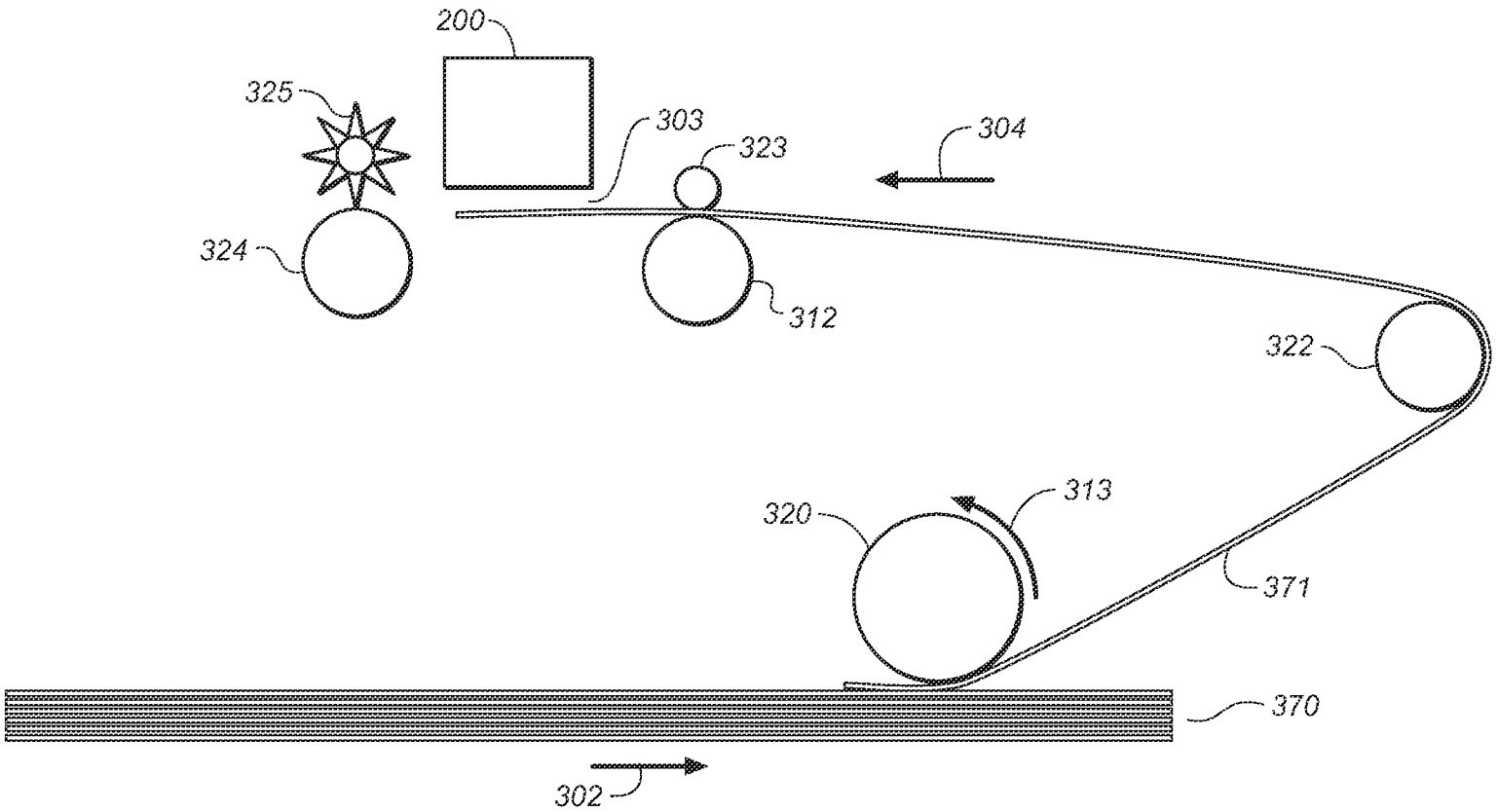
FIG. 4 is a schematic side view of an exemplary paper path in a carriage printer.

Paper or other recording medium (sometimes generically referred to as paper or media herein) is loaded along paper load entry direction 302 toward the front of printer chassis 308. A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along a media advance direction 304 from the rear 309 of the printer chassis (with reference also to FIG. 3). The paper is then moved by a feed roller 312 and idler roller(s) 323 to advance across print region 303 (platen not shown), and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is a maintenance station 330 including a cap 332 and a wiper (not shown).

Toward the rear of the printer chassis 309, in this example, is located an electronics board 390, which includes cable connectors 392 for communicating via cables (not shown) to the printhead carriage 200 and from there to the printhead 250. Also on the electronics board 390 are typically included motor controllers for the carriage motor 380 and for the paper advance motor, a processor and/or other control electronics (shown schematically as controller 14 and image processing unit 15 in FIG. 1) for controlling the printing process, a clock and an optional connector for a cable to a host computer.

Figure 5:
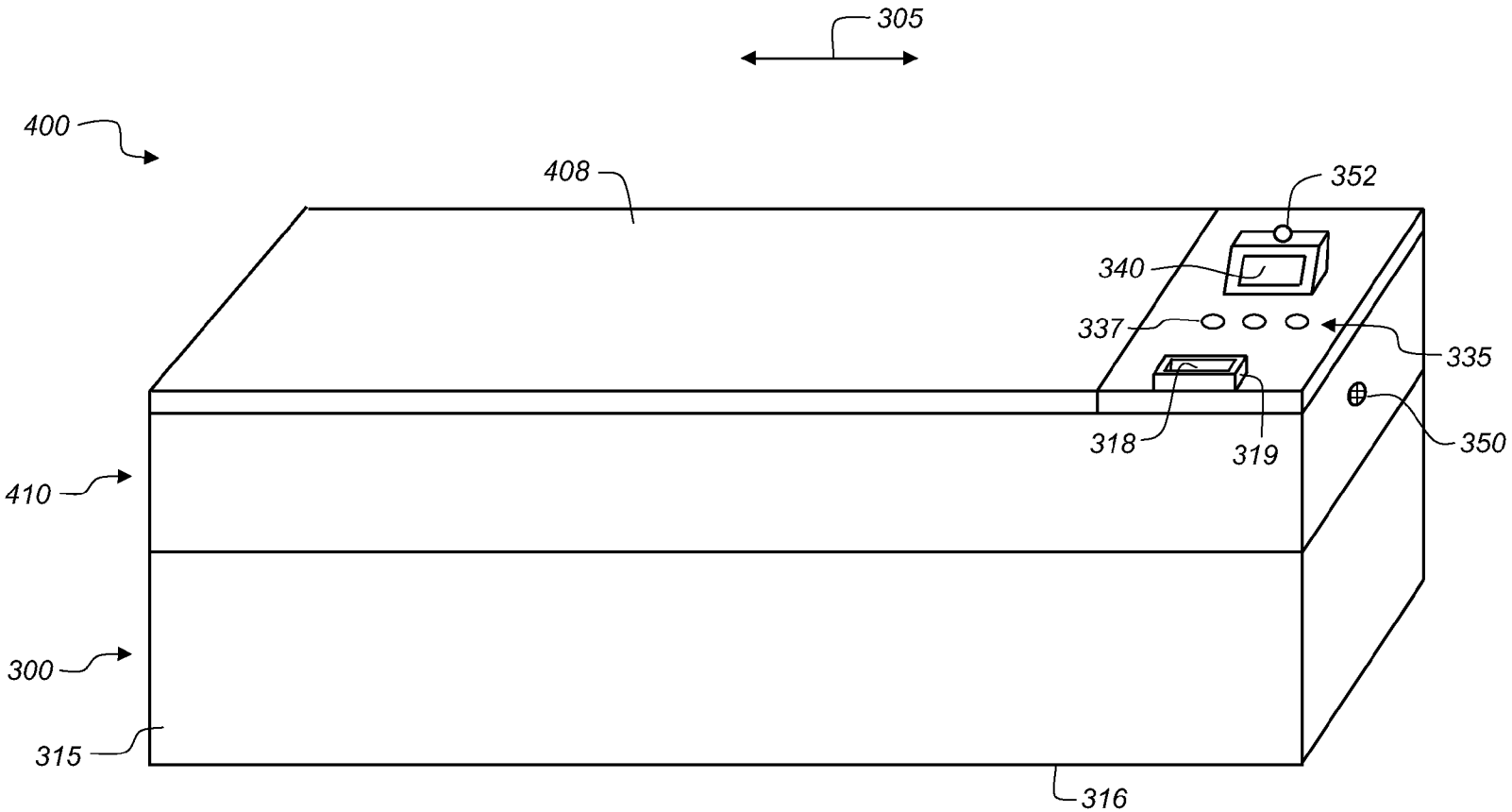
FIG. 5 is a perspective of a multifunction printer including a motion detector according to an embodiment.

FIG. 5 shows a multifunction printer 400 according to an embodiment of the invention. The multifunction printer 400 includes a printing mechanism for printing images, such as a carriage printer chassis 300 (FIG. 3), as well as a scanning apparatus 410 for scanning documents or other items. The scanning apparatus 410 includes a lid 408 that is pivotally attached. A housing 315 is attached to the printer frame 360 (FIG. 3) to provide an external portion of the multifunction printer 400. The housing 315 can include a portion that encloses the printer chassis 300 and a portion that encloses the scanning apparatus 410. In other embodiments (not shown) there is no scanning apparatus 410, and the housing 315 only encloses the carriage printer chassis 300. The multifunction printer 400 includes a display 340 and a control panel 335 having control buttons 337 for controlling the operation. Control buttons 337 can be separate from the display 340, or in the case of a touch screen, one or more control buttons can be integrated into the display 340.

Several different alternatives are shown in FIG. 5 for providing a motion detector 350. Motion detector 350 can include an accelerometer affixed to the housing 315. Alternatively, the motion detector 350 can include an optical sensor 352, such as a camera. In this example, optical sensor 352 is attached to the display 340 which is affixed to the housing 315. The motion detector 350 can be dedicated to the single function of detecting motion of the carriage printer. Alternatively, as in the case of a camera, the motion detector 350 can have additional purposes such as taking portraits, as disclosed in U.S. patent application Ser. No. 13/159,527 filed Jun. 14, 2011. The motion detector 350 can even be an external device, such as a mobile communication device (not shown) that is detachably mountable on the housing 315. Some smart phones that are currently commercially available include both a camera and one or more accelerometers. In some embodiments, a holding receptacle 318 is provided on the housing 315 in which the detachably mountable device is held. Walls 319 around the holding receptacle 318, or a friction pad (not shown) within the holding receptacle 318, or other ways of securing the external device can be provided in order to constrain the external device including the motion detector(s) to move along with the housing 315.

Generally only one motion detector 350 is needed, whether on the frame 360 (FIG. 3) or on the housing 315 (FIG. 5), and whether an accelerometer or an optical sensor 352. In any case, the motion detector 350 is typically mounted in such a way that it can detect motion of the carriage printer along a carriage scan direction 305 as a result of carriage acceleration and deceleration. For example, the optical sensor 352 such as a camera can take multiple sequential views of a stationary object such as a wall or a ceiling and monitor the apparent motion of a feature on that object as the optical sensor 352 moves with the carriage printer. The optical sensor 352 should have capability for acquiring images in rapid succession. Commercially available smart phones, for example, presently have the capability of acquiring images at 30 frames per second with VGA quality photos or HD video.

Figure 6:
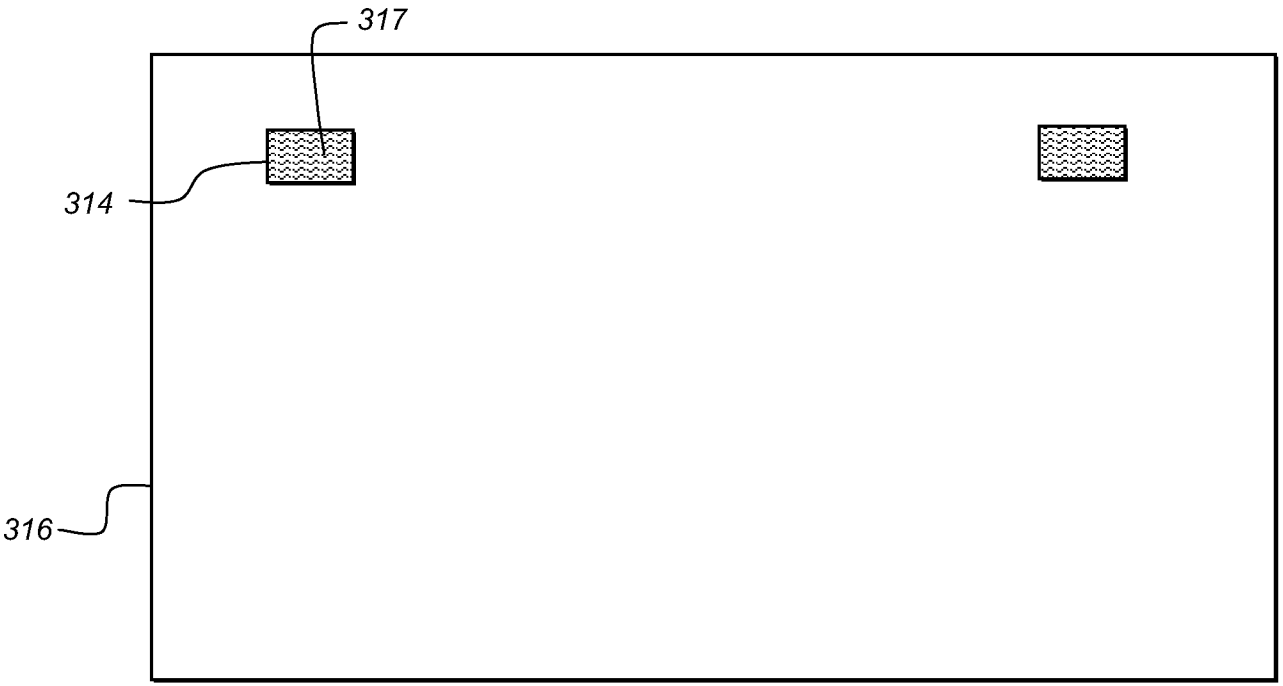
FIG. 6 is a bottom view of a base of a printer.

A base 316 of the multifunction printer 400 sits on a support unit in the user's environment such as a desktop or table during operation. As shown in the schematic bottom view of FIG. 6, the base 316 typically includes at least one pad 314 that is configured to contact a support surface when the printer is in its operating orientation. The pad 314, which can be an elastomeric pad for example, typically has a high friction contact surface 317. Generally contact surface 317 has a coefficient of friction that is higher than a coefficient of friction of the rest of the base 316, which is typically an injection molded hard plastic.

Figure 7:
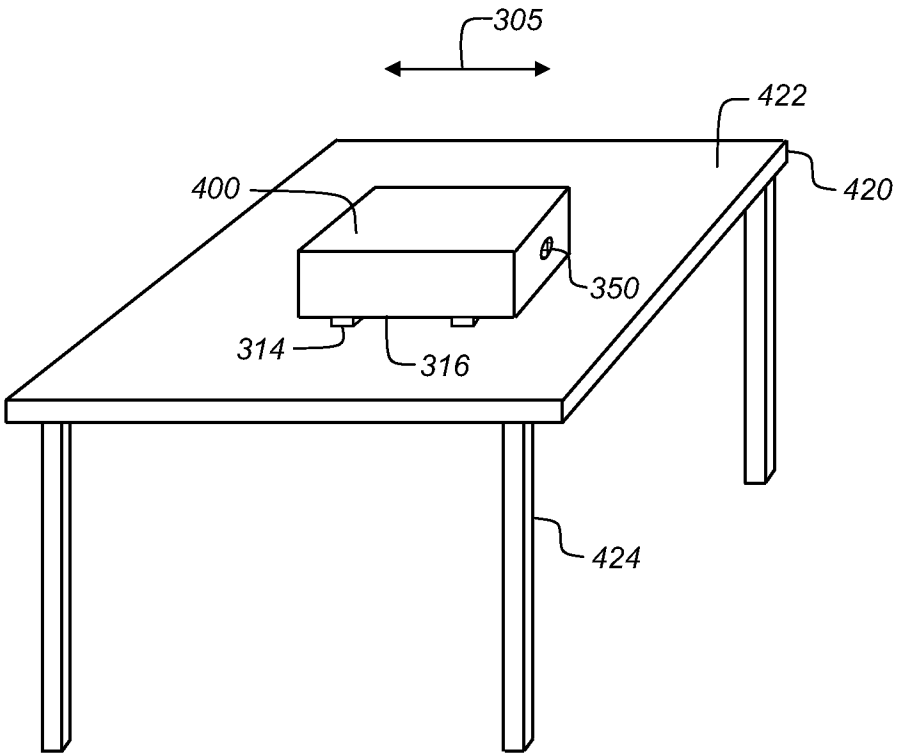
FIG. 7 is a perspective of a printer including a motion detector according to an embodiment and a support unit for the printer.

FIG. 7 shows a perspective of the multifunction printer 400 on a table 420. The high friction pads 314 on the base 316 are in contact with a support surface 422 of the table 420. The weight of multifunction printer 400 pressing down on the high friction pads 314 causes the motion of the multifunction printer 400 to be coupled to the support surface 422. For the case of a sturdy and massive table or desk or other such sturdy and massive support unit, the forces due to carriage acceleration and deceleration along the carriage scan direction 305 do not result in significant movement of the support unit. However, if as in the example of FIG. 7, the support unit is a lightweight table with somewhat spindly legs 424, as in a typical card table, carriage acceleration and deceleration forces along carriage scan direction 305 can result in significant shaking of the table 420. If, as in embodiments of the present invention, the multifunction printer 400 includes the motion detector 350 to detect movement of the printer due to carriage acceleration and deceleration forces, the motion of the carriage can be adapted within the user's environment to keep such movement of the printer and the user's work surface from being excessive.

Figure 8:
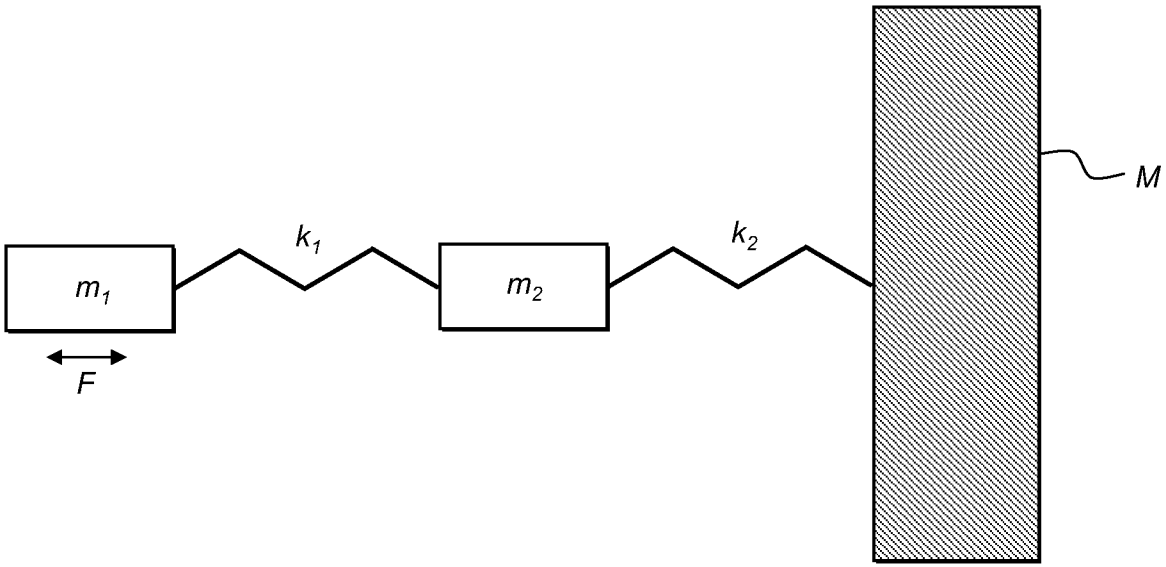
FIG. 8 is a schematic diagram of a mass driven by a periodic force in a system of coupled oscillators.

Shaking of a support unit that is induced by carriage acceleration and deceleration forces in a carriage printer is related to the motion of a mass $m_1$ driven by a periodic force F in a system of coupled oscillators, as illustrated in FIG. 8. Two masses $m_1$ and $m_2$ are coupled together and to a more massive object M by springs having spring constants $k_1$ and $k_2$. There are also frictional losses regarding the motion of each of the masses. A driven mass in a system of coupled oscillators often excites resonance modes, depending on characteristics of the system including the masses, the spring constants, and how the mass is driven. It is possible to suppress resonance modes by the manner in which the mass is driven. Two driving modes can result in similar motion of $m_1$, where the first driving mode excites resonant motion of $m_2$ and the second driving mode excites significantly less amplitude of motion of $m_2$. In this analogous problem, the driven mass $m_1$ is similar to the carriage, while the coupled mass $m_2$ is similar to the printer and support surface that the printer sits on. Mass M can be the floor that the support unit sits on. The driving force F and spring $k_1$ are similar to the carriage motor 380 and its belt 384 and pulley 387 (FIG. 3). Spring $k_2$ includes the high friction pads 314 on base 316 (FIG. 6) and legs 424 and the joints between the legs and the table's support surface 422 (FIG. 7). In order to suppress resonance, the driving force F can be subdivided into a sequence of steps that provide a close approximation to the desired motion of mass $m_1$, but do not excite resonance of mass $m_2$.

Figure 9:
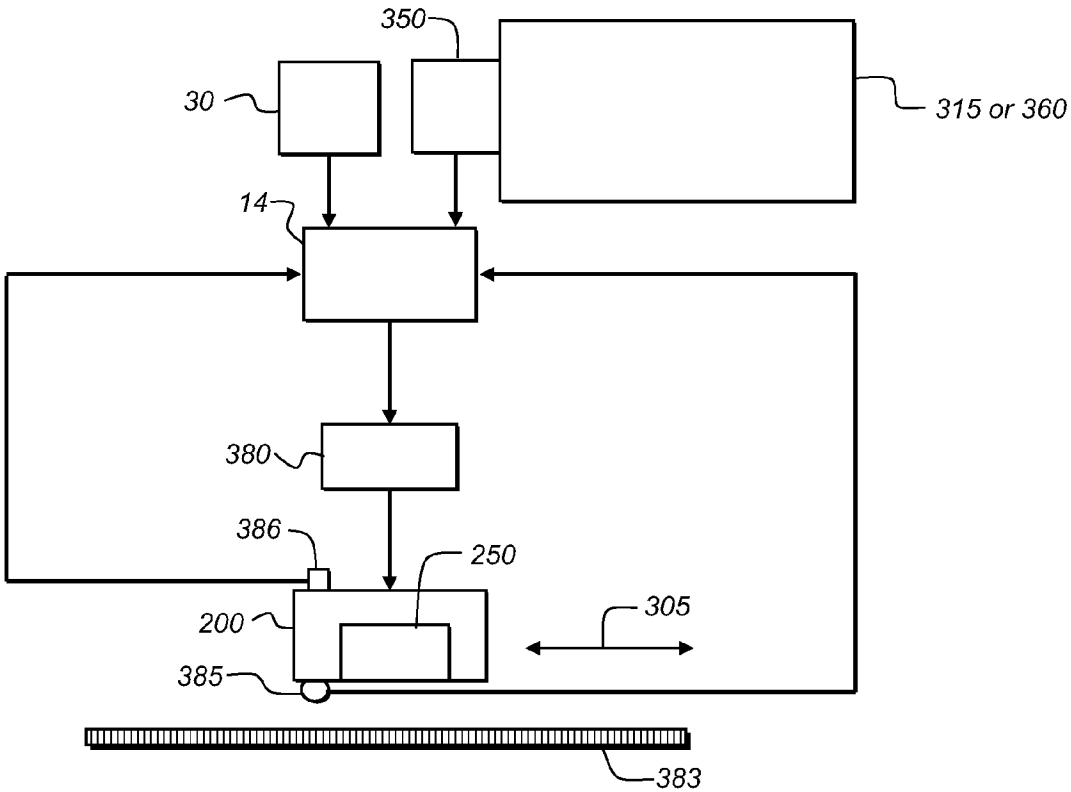
FIG. 9 is a block diagram of a motion control system for the carriage of a carriage printer according to an embodiment.

FIG. 9 shows a block diagram of the motion control system for the carriage 200. The carriage 200 moves the printhead 250 back and forth along the carriage scan direction 305. A linear encoder 383 is disposed along the carriage scan direction 305. An encoder sensor 385 is mounted on the carriage 200 and senses the regularly spaced black and white transitions on the linear encoder 383. The encoder sensor 385 sends signals corresponding to the black and white transitions to the controller 14. The controller 14 controls the carriage motor 380 to rotate in forward or reverse directions by amounts to move the carriage 200 at a speed and direction as needed.

The controller 14 can include a digital servo that uses error-sensing feedback to control carriage motion in various motion control modes. Carriage position is interpreted by the controller 14 based on the signals sent by the encoder sensor 385. Any difference between the actual and desired position (an error signal) is amplified and used to drive the carriage motor 380 in the direction necessary to reduce or eliminate the error. In addition to controlling carriage position, the digital servo can determine and control carriage velocity by monitoring carriage position by the signals from the encoder sensor 385 as a function of time, based on signals from a clock 30. Differences between actual and desired velocity provide a second error signal that is amplified to drive the carriage motor 380 in such a way as to provide a uniform desired velocity in the print region 303, for example. Acceleration and deceleration of the carriage 200 is similarly controlled according to the desired rate of change of velocity with time.

The details of how the acceleration and deceleration are applied during different time intervals will influence whether resonant motion of the carriage printer and its support unit in the user's environment will be excited or not. According to embodiments of the present invention, the controller 14 is configured to control carriage motor 380 using a motor control profile that is adaptable based on motion of the carriage printer, as detected by the motion detector 350.

Embodiments of methods of adaptively controlling motion of a carriage in a carriage printer within a user's environment are next described. The controller 14 controls the carriage motor 380 to move the carriage 200 within the user's environment according to a first motor control profile. Data is acquired by the motion detector 350 relative to motion of the housing 315 or the frame 360 of the carriage printer as the carriage 200 is moved according to the first motor control profile. Motion of the housing 315 or frame 360 will be referred to herein as motion of the carriage printer, as distinguished from motion of the carriage 200 which is detected by encoder sensor 385 and linear encoder 383. The acquired data relative to motion of the carriage printer as the carriage 200 is moved according to the first motor control profile is analyzed. The controller 14 then controls the carriage motor 380 to move the carriage 200 according to a second motor control profile. Data is acquired and analyzed relative to the motion of the carriage printer corresponding to the carriage 200 being moved according to the second motor profile. If motion of the carriage printer corresponding to the first or second motor profile is sufficiently low, no further motor control profiles need to be tested. However, if motion of the carriage printer is still excessive, the controller 14 then controls carriage motor 380 to move the carriage 200 according to a third motor control profile and the motion data is acquired and analyzed. The process can continue iteratively until a motor control profile is identified that results in a reduced amount of motion of the carriage printer compared with an amount of motion of the carriage printer resulting from the first motor control profile, and such that the amount of motion of the carriage printer with the identified motor control profile is acceptable.

Controlling of the carriage motor 380 with a first motor control profile, a second motor control profile, and further motor control profile iterations can be done according to a predetermined series of motor control profiles, with the selected motor control profile being the one having the least amount of motion detected by the motion detector. Alternatively, successive motor control profiles can be selected based on the analyzed motion data corresponding to the previous motor control profile(s). For example, the printer manufacturer can test the motion of the carriage printer as a function of motor control profiles with the printer mounted on a variety of types of support units that might typically be used in a user's environment. Motor control profile selection guidance can then be provided, for example in a look-up table, to help select a second motor control profile based on the analyzed data relative to the motion of the carriage printer corresponding to the carriage 200 being moved according to the first motor control profile while in the user's environment. Such a guided process can typically arrive at a satisfactory level of printer motion with fewer iterative steps.

Controlling the carriage motor 380 to move the carriage 200 according to the first motor control profile typically includes accelerating the carriage 200 to move in a first direction and decelerating the carriage 200 to a stop. In some embodiments, controlling the carriage motor 380 to move carriage 200 according to the first motor profile further includes accelerating carriage 200 to move in a second direction that is opposite the first direction, and decelerating carriage 200 to a stop, thereby completing a carriage motion cycle. In other embodiments, controlling carriage motor 380 to move carriage 200 according to the first motor control profile further includes accelerating and decelerating carriage 200 for a plurality of carriage motion cycles. The second motor control profile is similar to the first motor control profile in terms of the overall motion of carriage 200, but is different in the details of how acceleration and deceleration is done, for example how it is divided into different time intervals. In some embodiments a travel time of the carriage 200 for a second motor control profile that is less susceptible to inducing resonant motion of the printer and support unit can be substantially the same as a travel time of the carriage 200 corresponding to a first motor control profile that is more susceptible to inducing resonant motion. In other embodiments the travel time for the second motor control profile is longer than that for the first motor control profile, but not objectionably longer. Because the printer manufacturer can depend upon adapting the motion control to the user's environment, the default magnitudes of acceleration and deceleration can be made greater, and reduced as required for users having a support unit that is less massive and sturdy. In such embodiments, a message can be displayed to the user that higher printing throughput can be provided if the user moves the printer to a more massive and sturdy support unit.

The method of adaptively controlling motion of a carriage in a carriage printer within a user's environment is typically implemented for a new printer when it is first set up by the user. Optionally, it would be repeated if the motion detector 350 (e.g. accelerometer or optical sensor 352) detects a motion, or change of surroundings, or a change in the motion the carriage printer in response to the selected motor control profile that could indicate a change in the support unit. In addition, because the forces due to acceleration and deceleration of the carriage 200 also depend upon the mass of the carriage 200, in some embodiments the mass of the carriage 200 is monitored by a carriage mass monitor 386 and the mass is also used as an input to the controller 14 in selecting motor control profiles, as indicated in FIG. 9. One type of carriage mass monitor 386 is an ink level sensor for each of the ink supplies on the carriage 200. Ink level can be sensed directly using optical means for example in some embodiments, or it can be sensed indirectly by monitoring the amount of ink that has been used in printing and in maintenance operations. Information corresponding to the mass of the carriage when the ink supplies are full would be provided to the controller 14. Then as lower ink levels are sensed, a mass corresponding to the amount of used ink would be subtracted.

Data analysis of the motion of the carriage printer acquired by the motion detector 350 can include analytical methods such as performing a fast Fourier transform of the acquired data in order to provide a vibration frequency spectrum. Such a vibration frequency spectrum can then be used to identify characteristics of the resonant motion in order to guide selection of subsequent motor control profiles.

Some carriage printers have sufficient processing power in a microprocessor included in the controller 14 to analyze data from the motion detector 350 and to provide instructions for adapting the motor control profile. In other embodiments, an external computer to which the carriage printer is connected (through cables or through wireless connection) includes software to analyze data acquired from the motion detector 350 and to provide instructions to the controller 14 for adapting the motor control profile. Such an external computer can be a host computer for the printer, or it can be remotely connected through a network to the carriage printer. For embodiments using a mobile communication device as the motion detector 350, acquiring data relative to motion of the carriage printer can include transmission of data from the mobile communication device, either directly to the controller 14 of the printer, or to a remote server. In the latter case, the mobile communication device can include an application (or "app") for acquiring the data, transmitting it to a remote server, receiving instructions from the remote server after the server has analyzed the acquired data, and transmitting the instructions to controller 14.

The invention has been described in detail with particular reference to certain preferred embodiments thereof, but it will be understood that variations and modifications can be effected within the spirit and scope of the invention. For example, although the examples were described in terms of multifunction inkjet printers, use of the invention for a single function carriage printer, whether inkjet or some other marking technology, is also contemplated.

Parts List

10 Inkjet printer system
12 Image data source
14 Controller
15 Image processing unit
16 Electrical pulse source
18 First ink source
19 Second ink source
20 Recording medium
30 Clock
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
250 Printhead
251 Printhead die
252 Printhead face
253 Nozzle array
254 Nozzle array direction
255 Mounting substrate
256 Encapsulant
257 Flexible circuit
258 Connector board
Parts List Cont'd
262 Multichamber ink tank
264 Single chamber ink tank
275 Rear Wall
300 Printer chassis
301 Platen
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
314 Pad
315 Housing
316 Base
317 Contact surface
318 Holding receptacle

319 Wall
320 Pick-up roller
322 Turn roller
323 Idler roller
324 Discharge roller
325 Star wheel(s)
330 Maintenance station
Parts List Cont'd
332 Cap
335 Control panel
337 Control button
340 Display
350 Motion detector
352 Optical sensor
360 Frame
370 Stack of media
371 Top piece of medium
380 Carriage motor
382 Carriage guide rail
383 Linear encoder
384 Belt
385 Encoder sensor
386 Carriage mass monitor
387 Pulley
390 Printer electronics board
392 Cable connectors
400 Multifunction printer
408 Lid
410 Scanning apparatus
420 Table
422 Support surface
424 Leg

The invention claimed is:

1. A carriage printer comprising:

a housing having:

(a) a printhead;

(b) a print region;

(c) a carriage disposed on a carriage guide rail configured to move the printhead back and forth across the print region along the carriage guide rail disposed within the housing;

(d) a motor for moving the carriage;

a motion detector for detecting motion of the carriage printer; and a controller configured to control the motor, the controller including a motor control profile that is adaptable based upon the detected motion of the housing, which minimizes an amount of motion of the carriage printer caused by the carriage moving back and forth along the carriage guide rail.

2. The carriage printer of claim 1, wherein the motion detector is affixed to the housing.

3. The carriage printer of claim 1, wherein the motion detector is detachably mounted on the housing.

4. The carriage printer of claim 1 further comprising a printer frame to which the housing is attached, wherein the motion detector is affixed to the printer frame.

5. The carriage printer of claim 1, wherein the motion detector comprises an accelerometer.

6. The carriage printer of claim 1, wherein the motion detector comprises an optical sensor.

7. The carriage printer of claim 1, wherein the motion detector comprises a camera.

8. The carriage printer of claim 1 further comprising:

a linear encoder;

an encoder sensor mounted on the carriage proximate the linear encoder; and a clock, wherein a position and a velocity of the carriage are detectable by the controller based on inputs from the encoder sensor and the clock.

9. The carriage printer of claim 1, further comprising a base including at least one pad that is configured to contact a support surface when the printer is in its operating orientation.

10. The carriage printer of claim 9, wherein the at least one pad includes a contact surface having a coefficient of friction that is higher than a coefficient of friction of another portion of the base.

11. The carriage printer of claim 1 further including a connection to an external computer, wherein the external computer includes software to analyze data acquired from the motion detector and to provide instructions to the controller for adapting the motor control profile.

12. The carriage printer of claim 11, wherein the external computer is wirelessly connected to the carriage printer.

13. The carriage printer of claim 11, wherein the external computer is remotely connected to the carriage printer.

14. The carriage printer of claim 1, the controller further including a microprocessor to analyze data from the motion detector and to provide instructions for adapting the motor control profile.

15. The carriage printer of claim 1, the housing including a holding receptacle for a detachably mountable motion detector.

16. The carriage printer of claim 15, the holding receptacle including a friction pad.

* * * * *